US006371604B1

(12) United States Patent
Yamane et al.

(10) Patent No.: US 6,371,604 B1
(45) **Date of Patent: *Apr. 16, 2002**

(54) INK JET RECORDING HEAD ASSEMBLY HAVING AN URGING MEMBER FOR CONTACTING COMPONENTS THEREOF, THE URGING MEMBER HAVING AN INK SUPPLY MECHANISM, AND INK JET HEAD CARTRIDGE AND INK JET APPARATUS HAVING THE SAME

(75) Inventors: Toru Yamane, Yokohama; Toshiaki Hirosawa, Hiratsuka, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/747,078

(22) Filed: Nov. 8, 1996

(30) Foreign Application Priority Data

Nov. 9, 1995 (JP) ..... 7-291133

(51) Int. Cl.[7] ..... B41J 2/175; B41J 2/14
(52) U.S. Cl. ..... 347/85; 347/50
(58) Field of Search ..... 347/84, 85, 86, 347/87, 50, 20, 54, 42, 56, 57, 68, 58, 59

(56) References Cited

U.S. PATENT DOCUMENTS

| | | | | |
|---|---|---|---|---|
| 4,599,628 A | * | 7/1986 | Doring et al. | 347/85 |
| 5,243,363 A | | 9/1993 | Koizumi et al. | |
| 5,257,043 A | | 10/1993 | Kneezel | |
| 5,280,299 A | * | 1/1994 | Saikawa et al. | 347/87 |
| 6,155,677 A | * | 12/2000 | Kitani et al. | 347/65 |

FOREIGN PATENT DOCUMENTS

| | | | |
|---|---|---|---|
| JP | 01302829 | 12/1989 | H01L/21/60 |
| JP | 2-22064 | 1/1990 | |

* cited by examiner

*Primary Examiner*—Judy Nguyen
(74) *Attorney, Agent, or Firm*—Fitzpatrick, Cella, Harper & Scinto

(57) ABSTRACT

An ink jet recording head includes ink passages in fluid communication with ink ejection outlets; a liquid chamber for supplying liquid to the ink passages; a recording element substrate having a plurality of recording elements for generating energy for ejecting the ink; a driving element substrate driving element substrate having a driving element for selectively driving the recording elements; urging member for urging the recording element substrate and the driving element substrate to each other to press-contact them so as to electrically connect them with each other; wherein the urging member is provided with an ink supply mechanism for fluid communication with the liquid chamber.

10 Claims, 15 Drawing Sheets

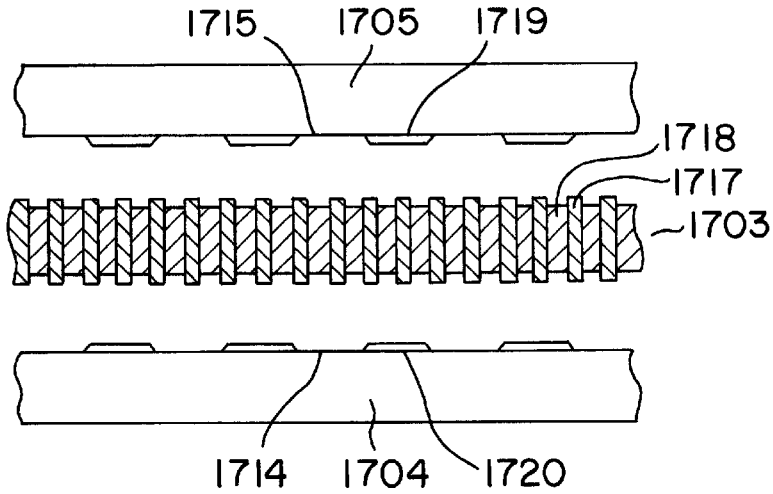
FIG. 4(a)
PRIOR ART
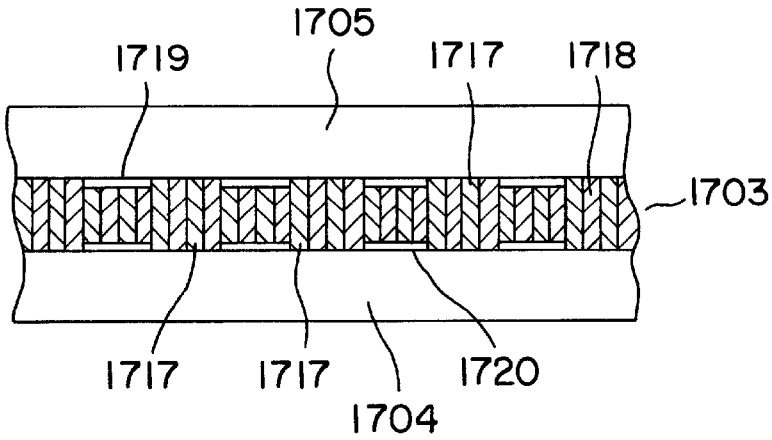
FIG. 4(b)
PRIOR ART
FIG. 4(c)
PRIOR ART
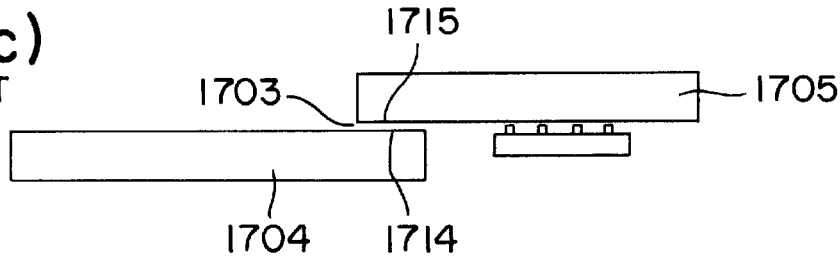

INK JET RECORDING HEAD ASSEMBLY HAVING AN URGING MEMBER FOR CONTACTING COMPONENTS THEREOF, THE URGING MEMBER HAVING AN INK SUPPLY MECHANISM, AND INK JET HEAD CARTRIDGE AND INK JET APPARATUS HAVING THE SAME

FIELD OF THE INVENTION AND RELATED ART

The present invention relates to an ink jet recording head comprising a recording element substrate and a driving element which are pressed together, wherein the recording element substrate comprises recording elements for ejecting ink, and the driving element substrate comprises driving elements for driving the recording elements in response to externally inputted image signals.

Regarding the terminology in the present invention, a word "recording" means "attaching meaningful patterns such as letters or geometrical figures to a recording medium as well as "attaching meaningless patterns to a recording medium."

(A) The present invention is applicable to an apparatus such as a printer which records patterns on a recording medium such as paper, thread, fiber, fabric, leather, metal, plastic, glass, wood, and ceramics. It is also applicable to an apparatus such as a copying machine, a facsimile machine comprising a communication system, or a word processor comprising a printing section. Further, it is applicable to an industrial recording apparatus integrally comprising a printing section and various processing apparatuses.

FIG. 1(*a*) is a plan view of the structure of a conventional recording element substrate of an ink jet recording head employed in an ink jet recording apparatus or the like, and FIG. 1(*b*) is a section of the structure illustrated in FIG. 1(*a*), at A-A1 line.

Referring to FIGS. 1(*a*) and 1(*b*), a reference numeral 1501 designates a substrate on which recording elements are disposed; 1502, a heat generating element, that is, a layer of heat generating resistor, for example, $HfB_2$; 1503, a common electrode composed of aluminum; 1504, an individual electrode composed of aluminum; 1505*a* and 1505*b*, patterned Al wiring; 1506, a photosensitive polyimide layer as an anti-oxidation layer as well as an insulative layer; and a reference numeral 1508 designates a Ta layer as an anti-cavitation layer.

The recording element substrate illustrated in FIGS. 1(*a*) and 1(*b*) generates thermal energy from the $HfB_2$ layer as electric current is flowed through the $HfB_2$ layer 1510 as a heat generating resistor layer. More specifically, in order to generate thermal energy in the heat generating element 1502, driving current is externally flowed into the $HfB_2$ layer 1502 through the individual electrode 1504 and the patterned wiring 1505*a*, and is flowed out through the patterned wiring 1505*b* and the common electrode 1503.

(B) FIG. 2 illustrates the structure of a recording element unit employing the recording element substrate described above. This recording element unit is provided with ink paths 1520 which lead to corresponding ejection orifices 1521. In each ink path 1520, a heating element is disposed. Ink is supplied into a liquid chamber 1530 through an ink supply port (unillustrated) of a top plate 1540, and is delivered to the ink path 1520 from the liquid chamber 1530.

As a driving signal is given to the heating element, a bubble is developed in the ink in the ink path, whereby the ink is ejected from the ejection orifice 1521.

Normally, a plurality of the heat generating elements 1502, which are constituted of a combination of the $HfB_2$ 1510, the dedicated electrode 1504, the patterned wiring 1505*a*, and the patterned wiring 1505*b*, are disposed on a single recording substrate. Deposing a plurality of heat generating elements on a single recording element substrate makes it possible to realize an ink jet recording apparatus capable of printing a plurality of dots at the same time, increasing recording speed. In particular, in the present situation in which demands for high density and high recording speed are rather high, it is quite common that a plurality of lines are recorded at the same time through a single scanning pass, and also, a recording element unit in which a large number of heat generating elements are disposed in high density is very common.

In order to record a plurality of dots by disposing a plurality of recording elements in a single recording unit, each recording element must be independently controlled (turned on or off). Such control is possible by providing the recording element unit with a means for selectively driving each of the heat generating elements (hereinafter, driving element). However, in the case of a long recording unit, that is, a recording unit comprising a large number of heat generating elements, the driving means is formed on a separate substrate (hereinafter, driving element substrate), and is connected to the recording unit. The reason for rendering the recording element unit and the driving element substrate independent from each other is due to the problem that when the recording element and the driving element are disposed on the same substrate, presence of a defect in either the recording element or the driving element causes the entire unit to stop functioning.

As for the technology (method) for electrically connecting the recording element substrate to the driving element substrate, there is a method disclosed in U.S. Pat. No. 5,243,363.

According to the aforementioned connecting method, a structure substantially the same as the structure illustrated in FIGS. 1(*a*) and 1(*b*) is employed. More specifically, a bump-like portion is formed on each of the dedicated electrodes, and, a recording element substrate 7001 attached to the main base board 7005 is joined with the driving element substrate 7002 having a driving IC 7003, by the application of pressure.

Japanese Laid-Open Patent Application No. 302,829/1989 discloses a different method which employs an electrical connecting member. FIGS. 4(*a*)–4(*c*) depict the connecting method disclosed the above patent application.

In FIG. 4, a reference numeral 1704 designates a recording element substrate; 1705, a driving element substrate; 1714 and 1715, electrode portions; and reference numerals 1719 and 1720 designate insulative film. Further, a reference numeral 1703 designates an electrically connective member; 1717, an electrically conductive member; and a reference numeral 1718 designates a supportive member for supporting the electrically conductive member 1717. The pitch of the electrically conductive member 1717 is narrower than those of the electrodes 1714 and 1715.

First, the recording element substrate 1704, driving element substrate 1705, and electrically connective member 1703 are arranged as shown in FIG. 4(*a*), and then, are pressed together as shown in FIG. 4(*b*). FIG. 4(*c*) gives the overall appearance of the joined three members. Since the pitch of the electrically conductive member 1717 is smaller than those of the electrodes 1714 and 1715, it is unnecessary to precisely position them; the electrodes 1714 and 1715 can be electrically connected through the electrically conductive member 1717, simply by pressing them together.

FIGS. 5 and 6 illustrate an example of a recording head constituted of a recording element and a separate driving element substrate. FIG. 5 is a perspective view of the recording head, and FIG. 6 is a section thereof, as seen from the direction indicated by an arrow mark in FIG. 5.

In the recording head illustrated in FIGS. 5 and 6, a recording element substrate 8001 and a driving element substrate 8002 are fixed to a main base board 8005 and an auxiliary substrate 8004, respectively. A filter for removing the bubbles and foreign matter within the recording liquid is fixed to the main base board 8005.

As for the method for electrically connecting the recording element substrate 8001 and the driving element substrate 8002, first, the connective electrode of the driving element substrate 8002 is accurately positioned relative to the connective electrode of the recording element substrate 8001, and the, the auxiliary base board 8004 is pressed toward the main base board by the pressing plate 8007, with an elastic member 8008 being interposed between the auxiliary base board and the pressing plate 8007.

Recording liquid is delivered to the recording element unit by an ink delivery system in which the recording element unit is connected to a filtering apparatus 8016 with the use of an ink delivery tube 8013, and the filtering apparatus 8016 and an unillustrated ink container are connected with the use of an ink delivery tube 8013.

When assembling the conventional ink jet recording head described above, or replacing it due to the failure of the recording element substrate 8001 or the recording element unit, the procedure for electrically connecting or disconnecting the recording element substrate and the driving element substrate, and the procedure for connecting or disconnecting the recording element unit and the ink delivery system, must be separately carried out, creating a problem in that it takes too much time and labor, and this problem had to be solved.

Also, even when only the recording element substrate needs to be replaced, the filtering apparatus and the ink delivery tube must be replaced together with the recording element substrate, adding to the time and cost for replacing the recording element substrate. This problem must be also solved.

The present invention was made in view of the above described problems which the conventional method has, and its primary object is to greatly simplify the procedure for replacing the recording element substrate, and also to reduce the component count, so that it becomes possible to provide an inexpensive ink jet recording apparatus which allows the recording element substrate to be quickly replaced.

SUMMARY OF THE INVENTION

The structure of the ink recording head in accordance with the present invention made to accomplish the above objects is as follows.

According to the present invention, an ink jet recording apparatus comprises: an ink path leading to an ejection orifice for ejecting ink; a liquid chamber from which ink is delivered to the ink path; a recording element substrate having a plurality of recording elements of generating the ink ejecting energy; a driving element substrate having a plurality of driving elements for selectively driving the recording elements; and a pressing means for providing the pressure for keeping the recording element substrate and the driving element substrate physically in contact with each other, wherein the pressing means comprises an ink delivery system for delivering ink from the liquid chamber to the ink jet head.

An ink jet head cartridge comprises the ink jet recording head described above, and an ink container which holds the ink to be delivered to the ink jet head.

An ink jet recording apparatus comprises the ink jet recording apparatus described above, and a means for generating a signal which drives the ink jet recording head.

Further, according to the present invention, component count, and assembly or disassembly steps, can be greatly reduced by adopting the structure described above.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4(*a*), FIG. 4(*b*) and FIG. 4(*c*) are schematic drawings depicting the steps through which the recording element substrate and the driving element substrate are electrically connected with the use of an electrically connective member.

DESCRIPTION OF THE PREFERRED EMBODIMENTS

Hereinafter, the preferred embodiments of the present invention will be described with reference to the drawings.

Embodiment 1

Figure 7:
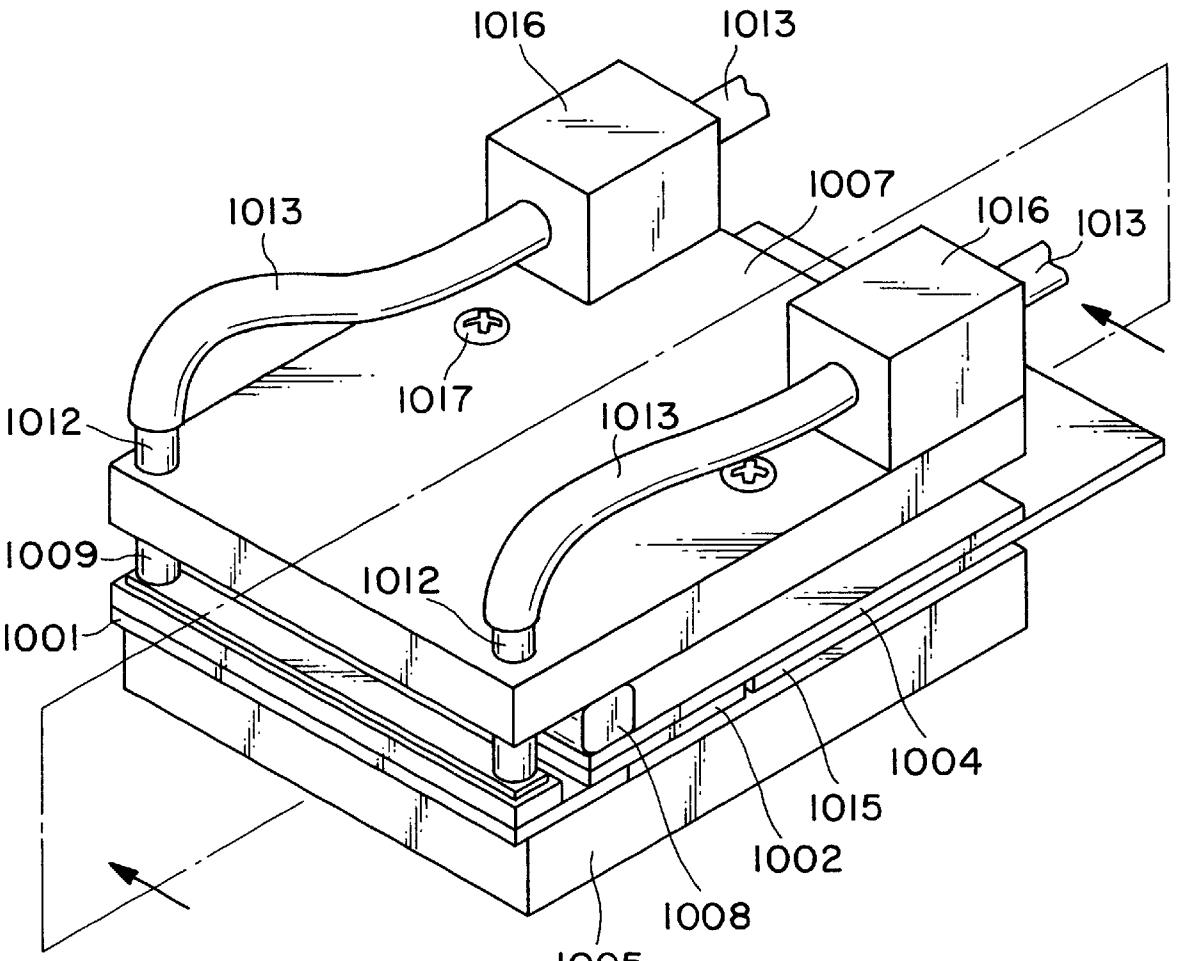
FIG. 7 is a schematic perspective drawing depicting the structure of the ink jet recording head in accordance with the present invention.
Figure 8:
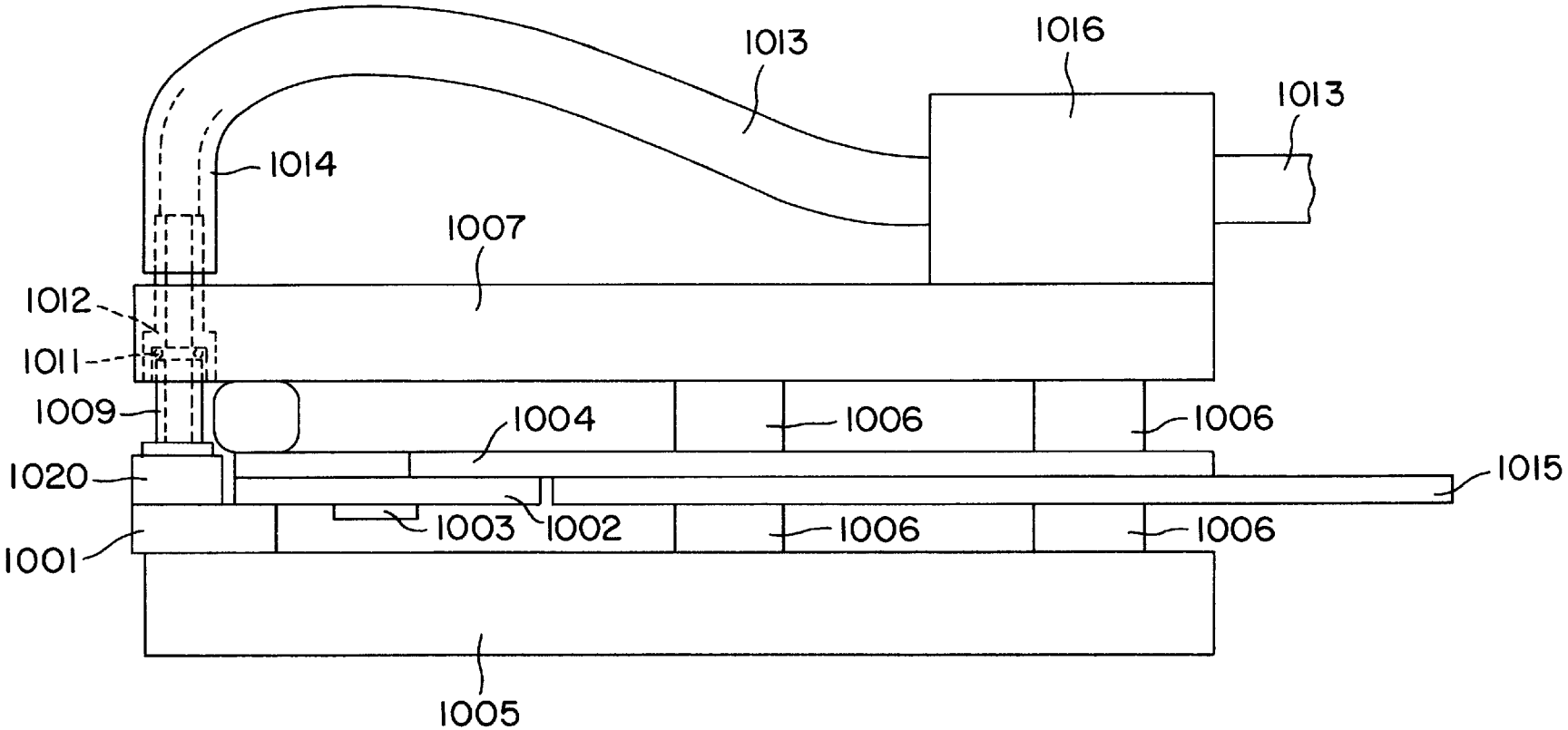
FIG. 8 is a schematic section of the structure illustrated in FIG. 7.

FIGS. 7 and 8 are drawings which depict the first embodiment of the present invention, FIG. 7 being a perspective external view of the ink jet recording head in this embodiment and FIG. 8 being a sectional view of the ink jet recording head depicted in FIG. 7, as seen from the direction indicated by an arrow mark in FIG. 7.

Figure 1A:
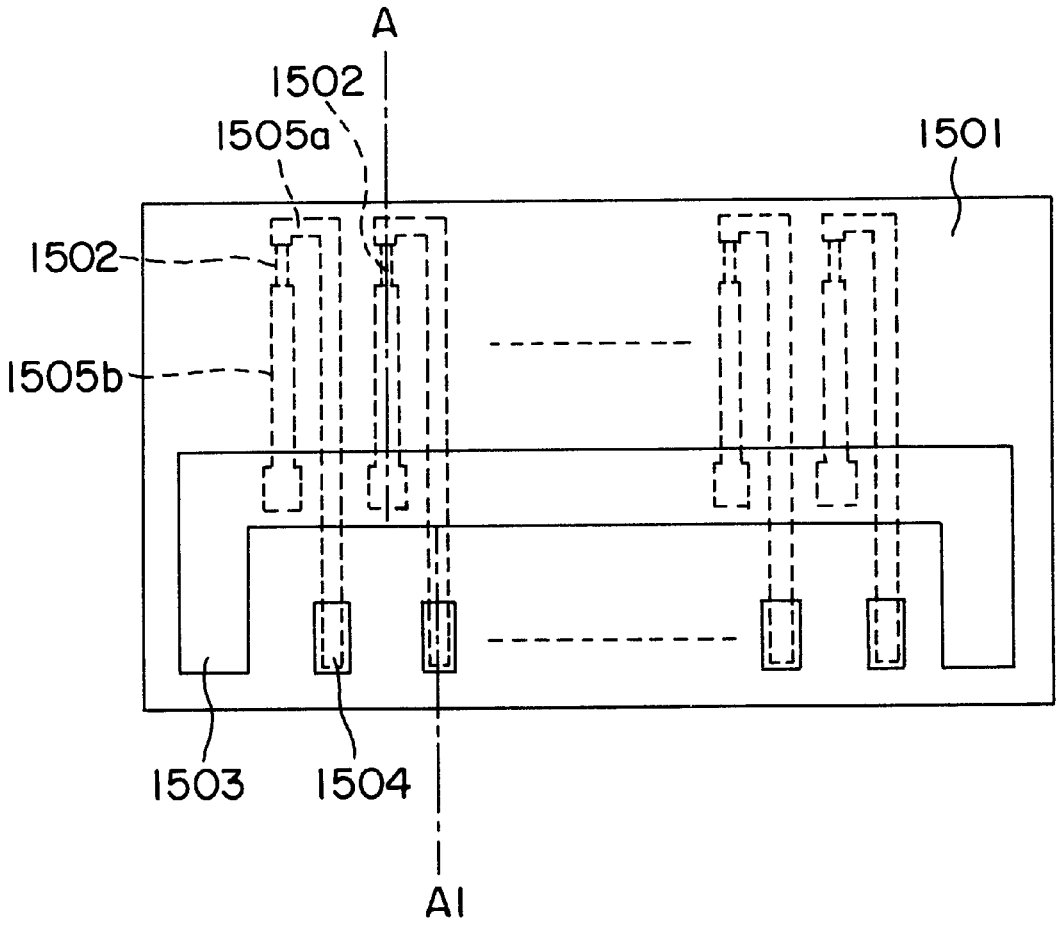
FIG. 1(a) PRIOR ART
FIG. 1(*a*) and FIG. 1(*b*) are schematic views of the recording element substrate in a conventional ink jet recording head.
Figure 1B:
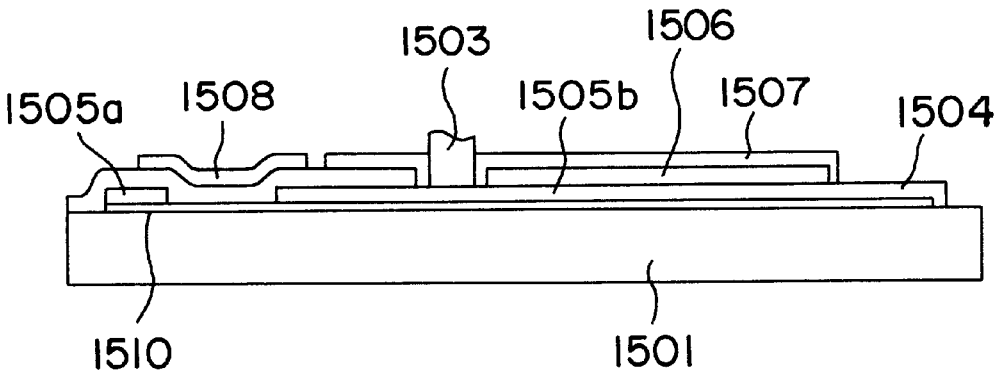
FIG. 1(b) PRIOR ART
Figure 2:
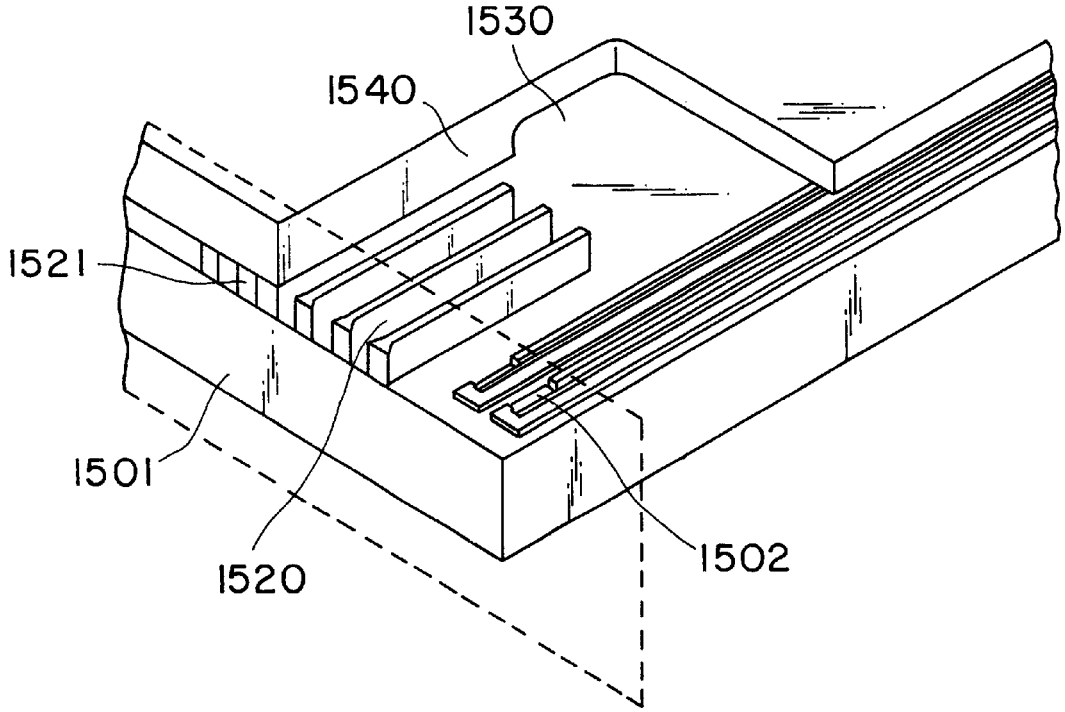
FIG. 2 PRIOR ART
FIG. 2 is a perspective view of a partially cutaway recording element unit in an ink jet recording head.
Figure 3:
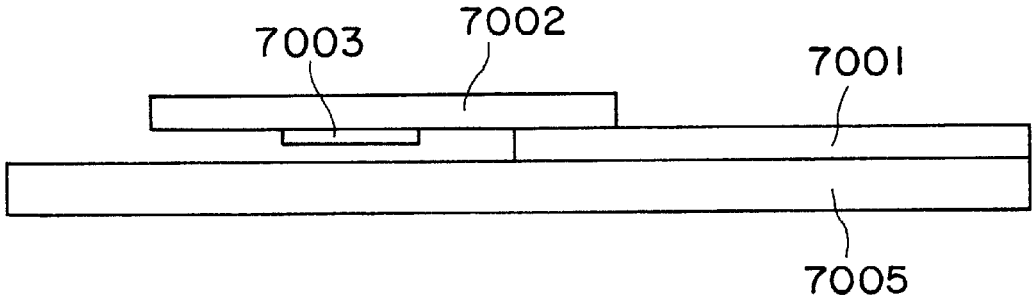
FIG. 3 PRIOR ART
FIG. 3 is a schematic drawing depicting how a recording element substrate and a drawing element substrate are connected.
Figure 5:
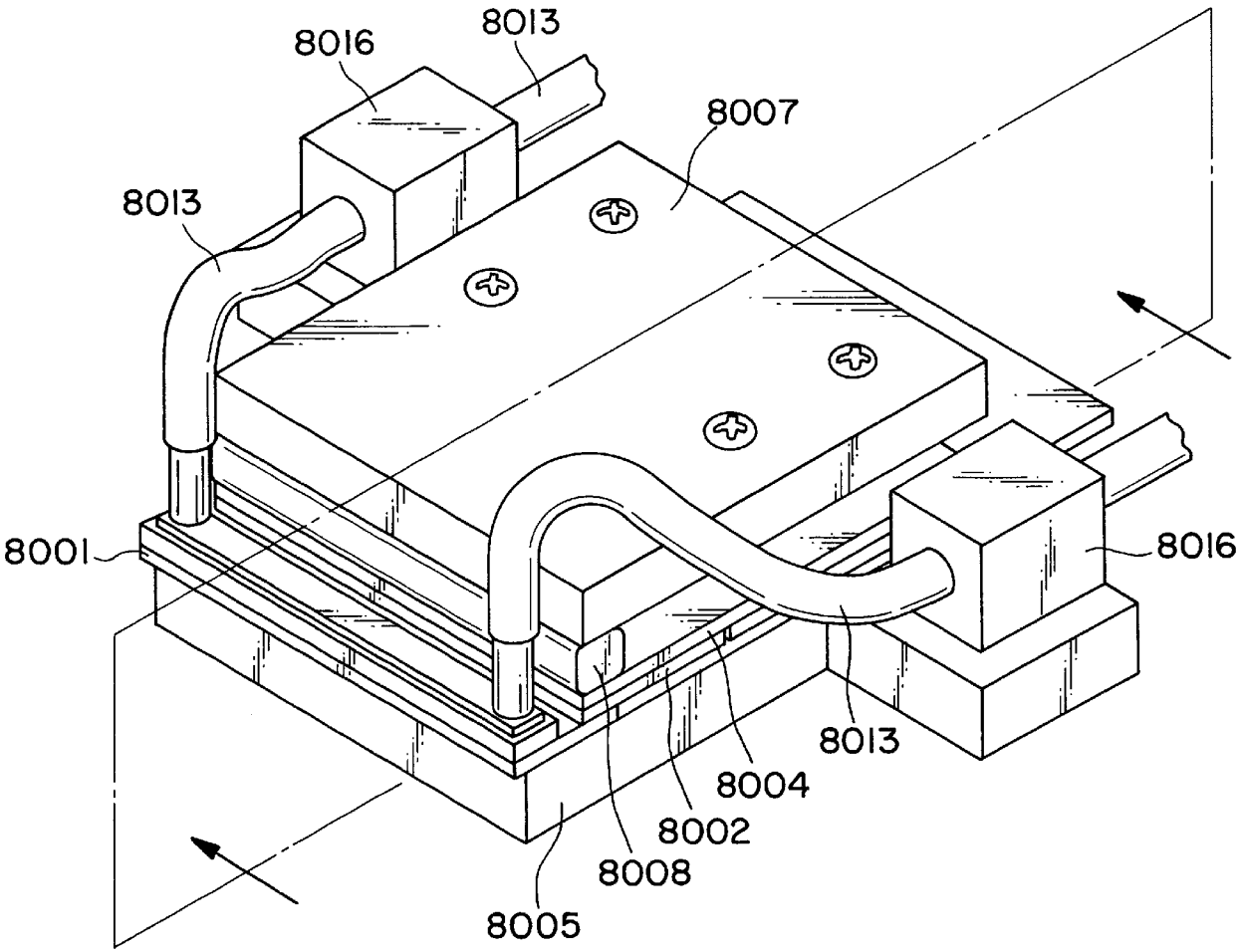
FIG. 5 PRIOR ART
FIG. 5 a perspective drawing depicting how the recording element substrate is electrically connected to the driving element substrate using a pressing means.
Figure 6:
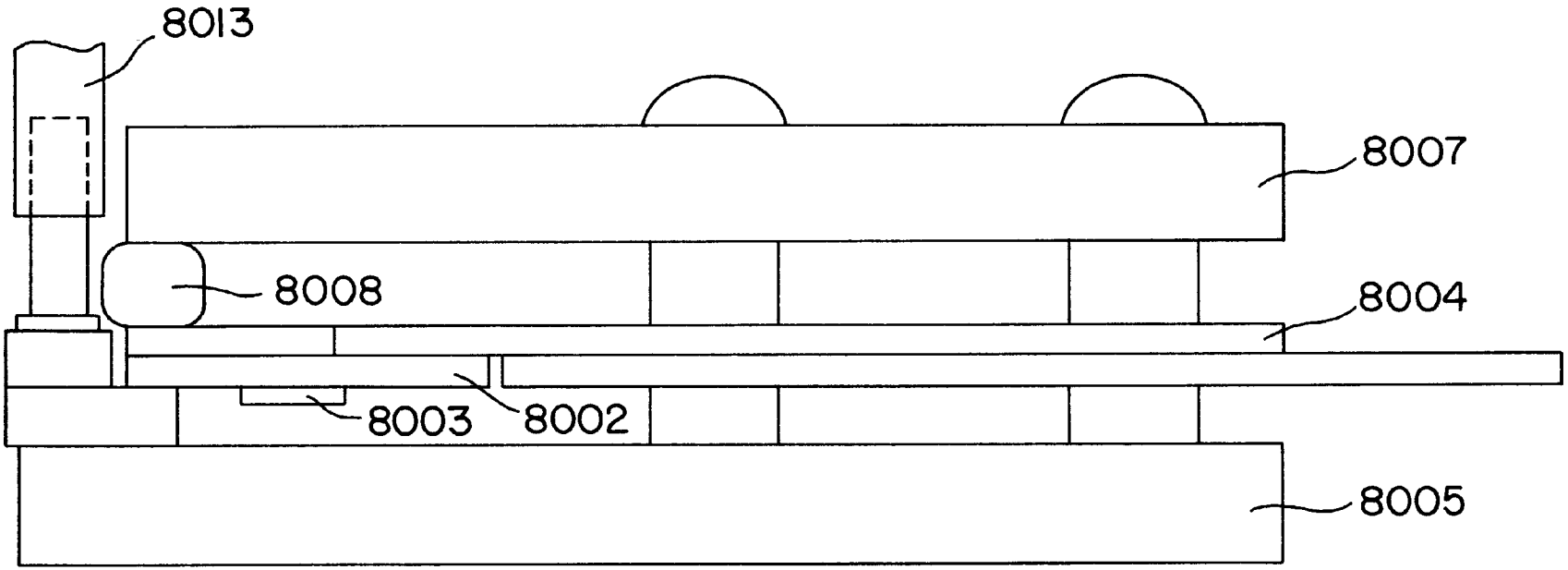
FIG. 6 PRIOR ART
FIG. 6 is a schematic section of the structure illustrated in FIG. 5.

In both drawings, a reference numeral 1001 designates a recording element substrate; 1020, a liquid path formation member which forms a liquid path or a liquid chamber as it is joined with the recording element substrate as shown in FIG. 2; 1002, a driving element substrate; 1003, a driving IC as the driving element; 1004, an auxiliary base board; 1005, a main base board as a member constituting a part of the pressing means; 1006, a spacer; 1007, a pressing plate as a pressing member constituting the pressing means; 1008, an elastic member; 1009, and ink reception port; 1011, an O-ring; 1012, a connective pipe; 1013, an ink delivery tube; 1014, an ink path; 1015, a circuit substrate; 1016, a filtering apparatus; and a reference numeral 1017 designates a screw.

The recording head in this embodiment is provided with two ink reception ports, each being on the corresponding longitudinal end of the liquid path formation member joined with the recording element substrate 1001 fixed to the main base board 1005. The driving element substrate 1002 is fixed to the auxiliary base board along with the circuit substrate 1015, and the driving element substrate 1002 and the circuit substrate 1015 are electrically connected by wire bonding or the like. The connective pipe 1012 and the filtering apparatus 1016, which are connected, with the use of the connective tube 1013, to constitute a part of an ink delivery system connected to the ink reception port 1009 of the recording element substrate 1001, are fixed to the pressing plate 1007 which presses together the recording element substrate 1001 and the driving element substrate 1002.

Next, the connective electrode of the recording element substrate 1001 and the connective electrode of the driving element substrate 1002 are precisely positioned relative to each other, and are placed between the pressing plate 1007 and the main base board 1005. Then, the pressing plate 1007 and the main base board 1005 are pressed toward each other by the screw 1017, whereby the auxiliary base board 1004 is squeezed toward the main base board 1005 by the elastic member 1008, applying pressure upon the recording element substrate 1001 and the driving element substrate 1002. This pressure places the recording element substrate 1001 and the driving element substrate 1002 firmly in contact with each other, electrically connecting them, and at the same time, connecting the ink delivery systems of both substrates.

The aforementioned connective portions may be provided with a small bump, or an electrical connector, to improve the state of the connection.

At the same time as the connective portions of the two substrates are connected, the ink reception port 1009 of the recording element substrate 1001 is connected to the connective pipe 1012 having been fixed to the pressing plate 1007, with the interposition of the O-ring between the two. In other words, fixation of the pressing plate 1007 electrically connects the recording element substrate 1001 and the driving element substrate 1002, and also connects the recording element substrate 1001 to the ink delivery system, at the same time. This is in contrast to the conventional arrangement where, as noted above, these connections must be performed separately.

In this embodiment, there are two ink delivery systems which are connected to the corresponding ink reception ports 1009 of the liquid path formation member, and both are used as the ink delivery path into the recording element unit. However, one of the system may be used as a system for receiving ink from the recording element unit so that two systems constitute an ink circulation path together with other members.

Embodiment 2

Figure 9:
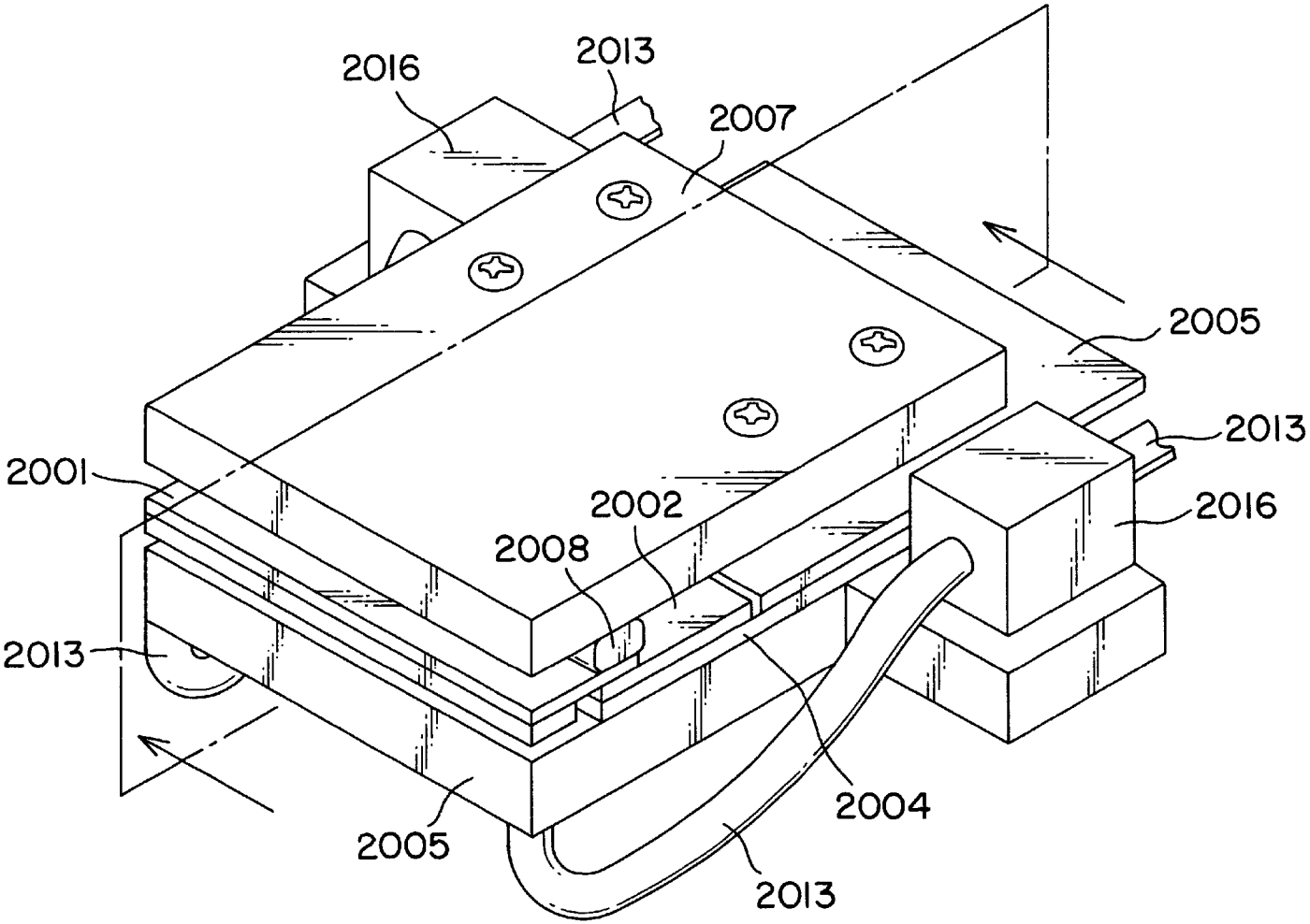
FIG. 9 is a perspective drawing depicting the structure of another ink jet recording apparatus in accordance with the present invention.
Figure 10:
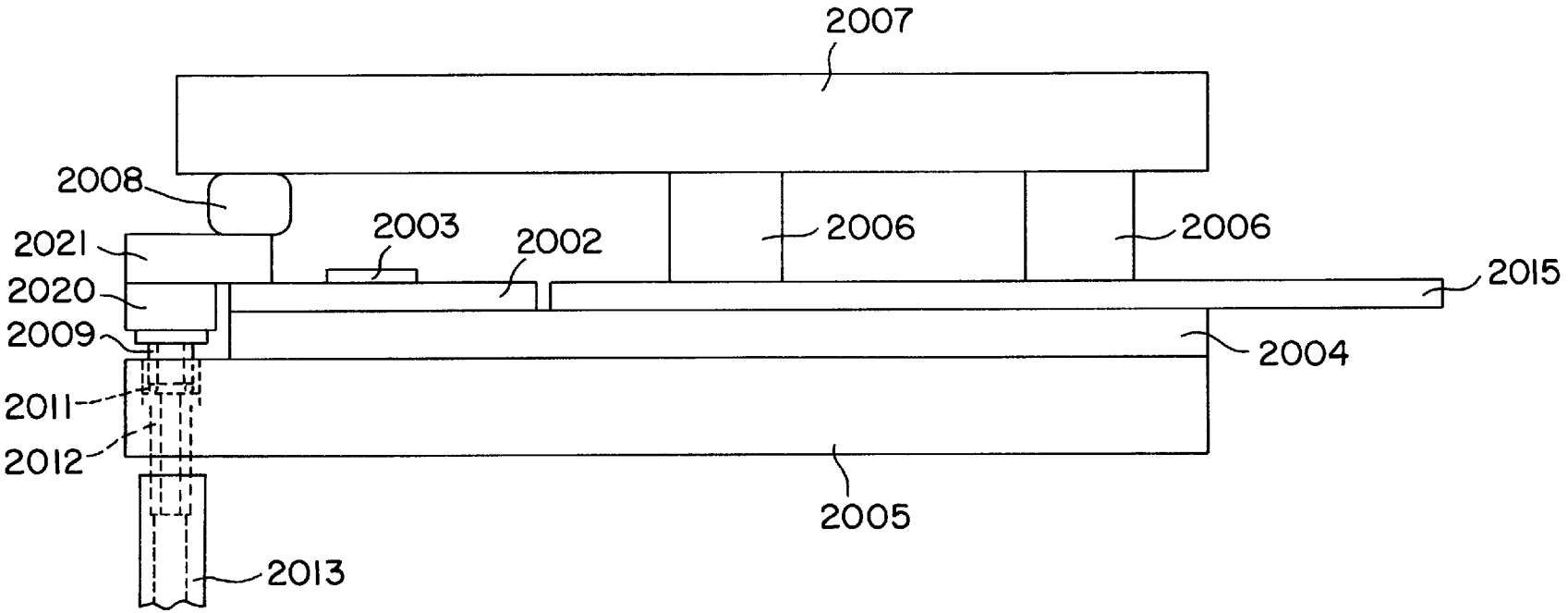
FIG. 10 is a schematic section of the structure in FIG. 9.

FIGS. 9 and 10 are drawings depicting the second embodiment of the present invention. FIG. 9 is an external perspective view of the ink jet recording head in this embodiment, and FIG. 10 is a schematic section of the same, as seen from the direction indicated by an arrow mark in FIG. 9.

In the drawings, a reference numeral 2001 designates a recording element substrate; 2020, a liquid path formation member; 2002, a driving element substrate; 2003, a driving IC as the driving element; 2004, an auxiliary base board; 2005, a main base board; 2006, a spacer; 2007, a pressing plate; 2008, an elastic member; 2009, an ink reception port; 2011, an O-ring; 2012, a connective pipe; 2013, an ink delivery tube; 2014, an ink path; 2015, a circuit substrate; 2016, a filtering apparatus; and a reference numeral 2017 designates a fixing screw.

In this embodiment, the driving element substrate 2002 and the circuit substrate 2015 are fixed to the main base board 2005, and also are electrically connected to each other by wire bonding or the like. The connective pipe 2012 and filtering apparatus 2016, which constitute a part of the ink delivery system connected to the ink reception port 2009 of the liquid path formation member 2020, are connected to each other with the use of the ink delivery tube 2013, but unlike the preceding embodiment, the connective pipe 2012 and the filtering system 2016 are fixed to the main base board 2006. The connective electrode of the recording element substrate 2001 and the connective electrode of the driving element substrate 2002 are precisely positioned relative to each other, and pressure is applied from behind the recording element substrate 2001 by the pressing plate 2007, with interposition of the elastic member 2008 between the recording element substrate 2001 and the pressure plate 2007, in the same manner as the first embodiment. As a result, the recording element substrate 2001 and the driving element substrate 2002 are electrically connected.

At the same time, the ink reception port 2009 of the recording element substrate 2001 and the connective pipe 2012 fixed to the main base board are connected with the interposition of the O-ring between the two.

In other words, fixation of the pressing plate 2007 makes it possible to electrically connect the recording element substrate 2001 and the driving element substrate 2002, and connect the recording element substrate 2001 to the ink delivery system, at the same time.

Compared to Embodiment 1, the number of the components attached to the recording element 2001 in this embodiment is smaller. Therefore, the cost involved when the recording element substrate 2001 is replaced can be minimized.

Embodiment 3

Figure 11:
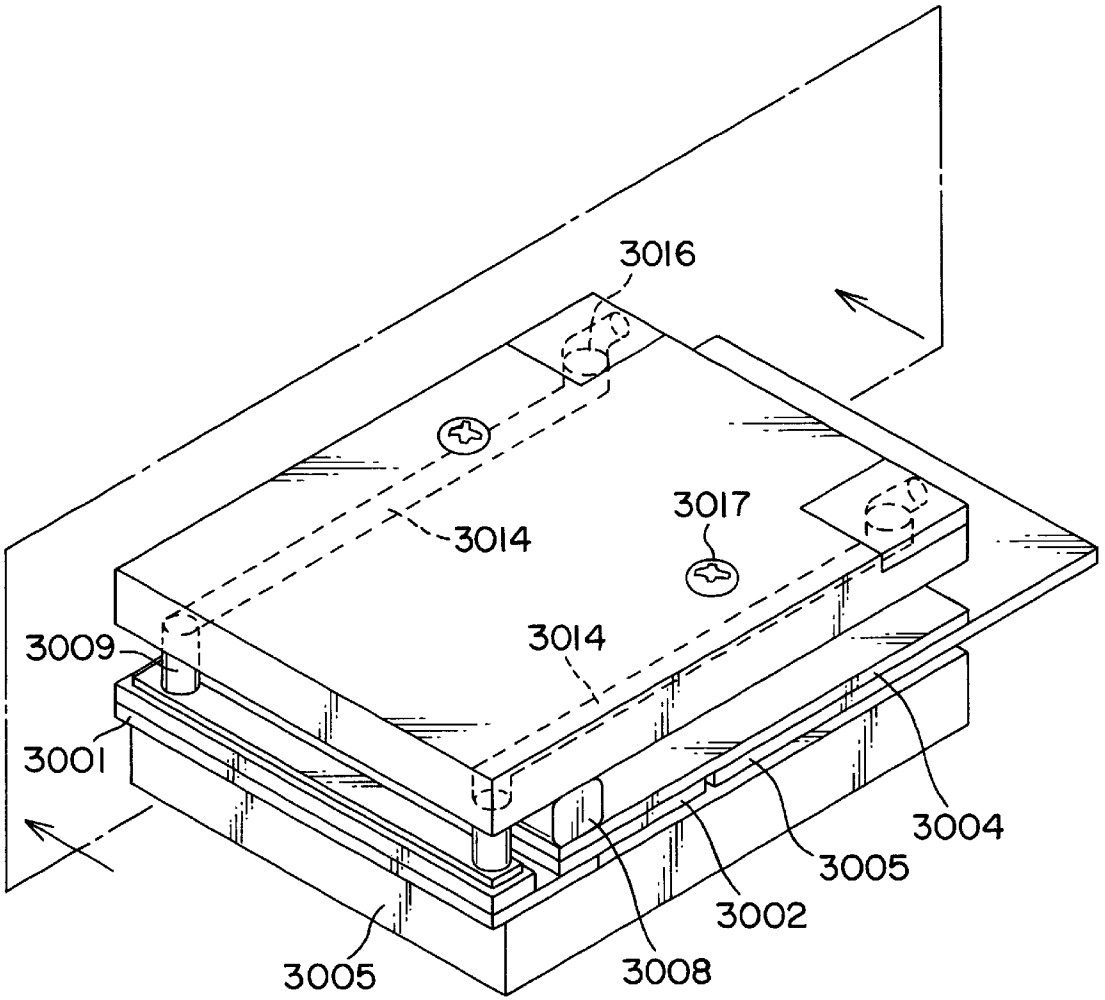
FIG. 11 is a perspective drawing depicting the structure of another ink jet recording head in accordance with the present invention.
Figure 12:
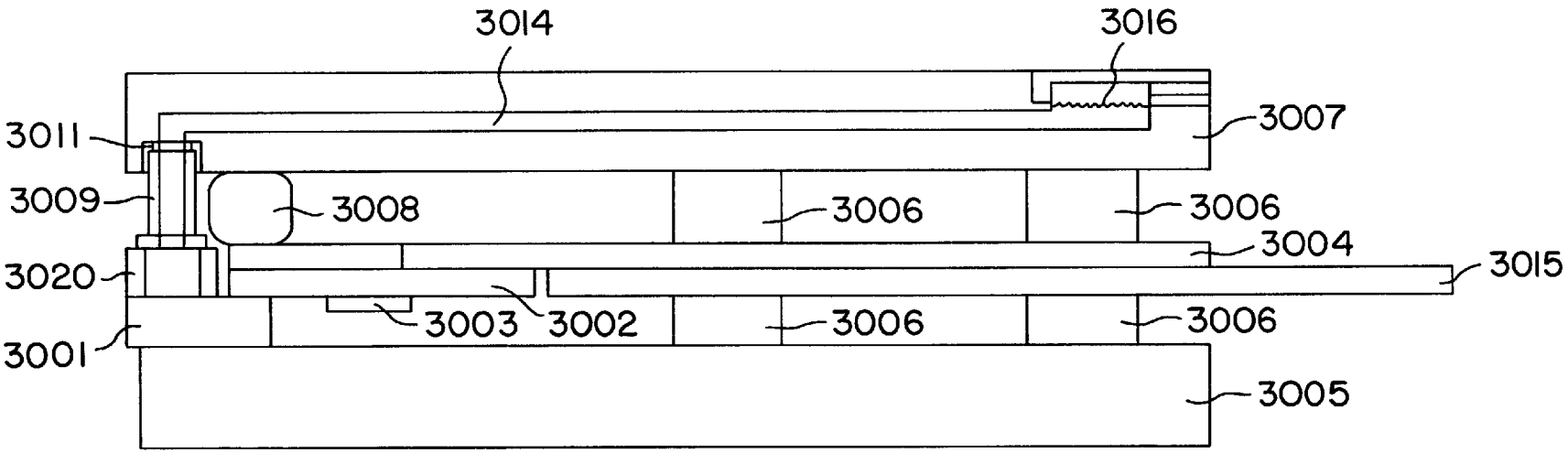
FIG. 12 is a schematic section of the structure in FIG. 11.

FIGS. 11 and 12 depict the third embodiment of the present invention. FIG. 11 is an external perspective view of the ink jet recording head in this embodiment, and FIG. 12 is a section of the same as seen from the direction indicated by an arrow in FIG. 11.

In the drawings, a reference numeral 3001 designates a recording element substrate; 3020, a liquid path formation member; 3002, a driving element substrate; 3003, a driving IC; 3004, an auxiliary base board; 3005, a main base board; 3006, a spacer; 3007, a pressing plate; 3008, an elastic member; 3009, an ink reception port; 3011, an O-ring; 3012, a connective pipe; 3013, an ink delivery tube; 3014, an ink path; 3015, a circuit substrate; 3016, a filtering apparatus; and a reference numeral 3017 designates a fixing screw.

In this embodiment, at the same time as the recording element substrate 3001 is electrically connected to the driving element substrate 3002 by the pressing plate 3007, the liquid path formation member 3020 is connected to the ink delivery system also by the pressing plate 3007. In this case, however, the connective portion to which the ink delivery port 3009 of the recording element substrate 3001 is connected, and the ink delivery path 3014 and filtering apparatus 30016 which constitute a part of the ink delivery system, are integrally formed in the pressing plate 3007.

Therefore, the component count can be further reduced compared to Embodiment 1, which makes it possible to reduce the number of assembly steps, the recording head cost, and the recording head size.

Embodiment 4

Figure 13:
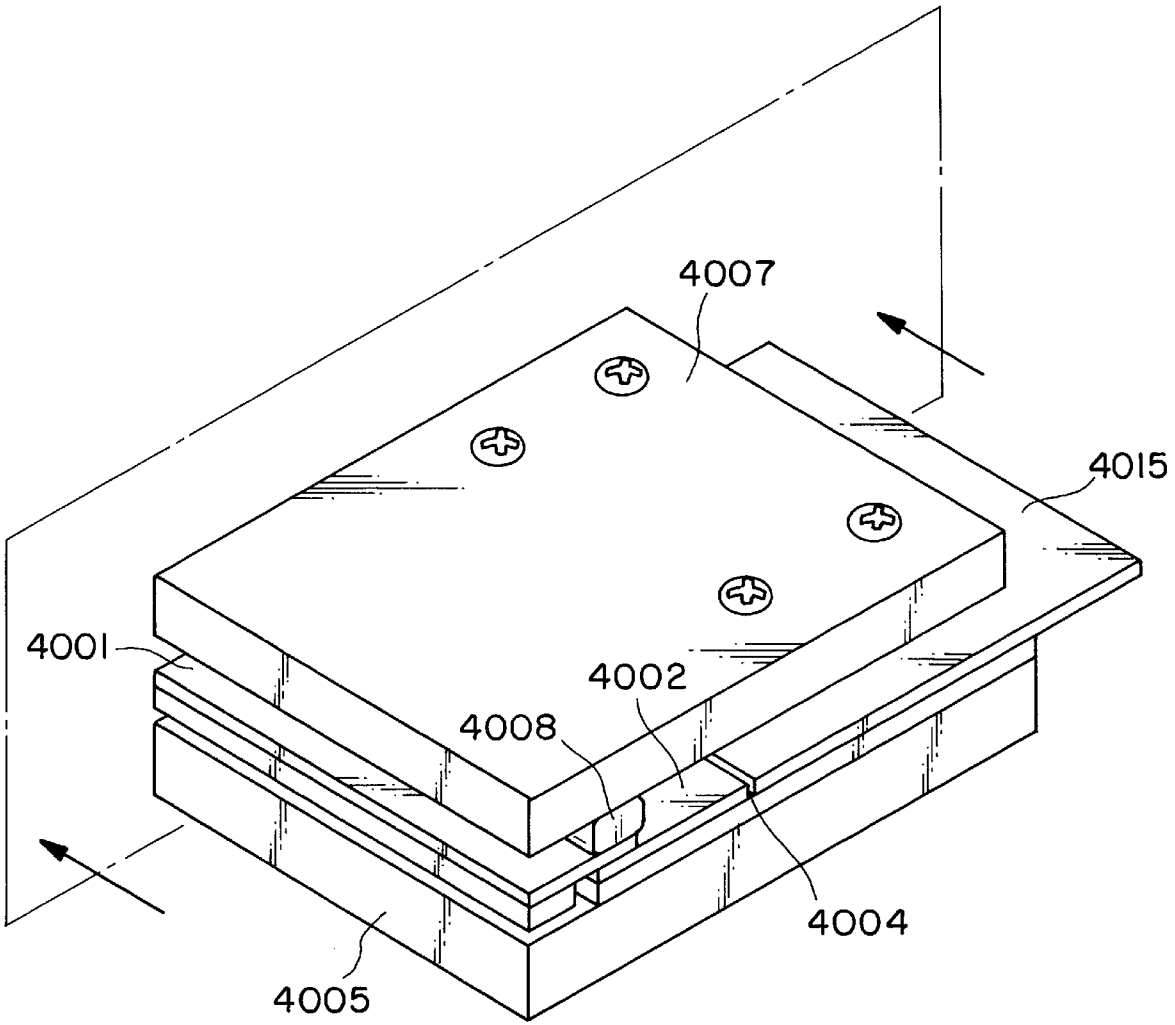
FIG. 13 is a perspective drawing depicting the structure of another ink jet recording apparatus in accordance with the present invention.
Figure 14:
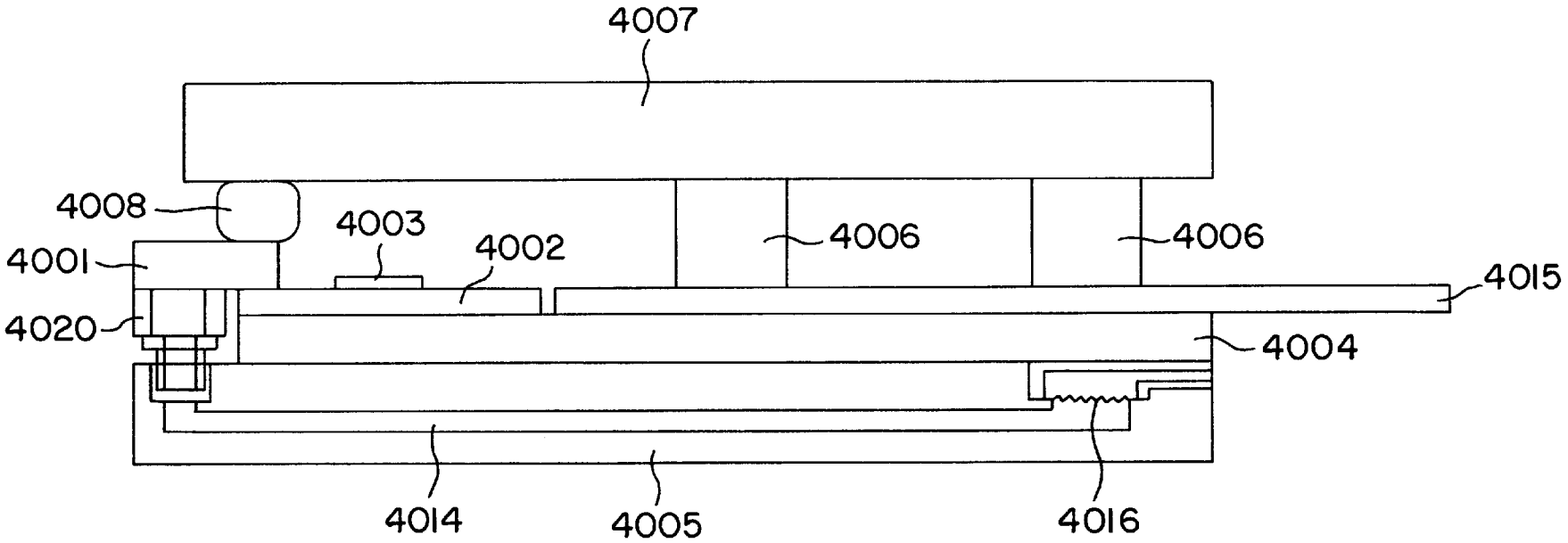
FIG. 14 is a schematic section of the structure in FIG. 13.

FIGS. 13 and 14 depict the fourth embodiment of the present invention, FIG. 13 is an external perspective view of the ink jet recording head in this embodiment, and FIG. 14 is a section of the same as seen from the direction indicated by an arrow mark in FIG. 13.

In the drawings, a reference numeral 4001 designates a recording element substrate; 4020, a liquid path formation member; 4002, a driving element substrate; 4003, a driving IC; 4004, an auxiliary base board; 4005, a main base board; 4006, a spacer; 4007, a pressing plate; 4008, an elastic member; 4009, an ink reception port; 4011, an O-ring; 4012, a connective pipe; 4013, an ink delivery tube; 4014, an ink path; 4015, a circuit substrate; 4016, a filtering apparatus; and a reference numeral 4017 designates a fixing screw.

In this embodiment, the same structure as that in Embodiment 2 is employed. Thus, at the same time as the recording element substrate 4001 is electrically connected to the driving element substrate 4002 by the pressing plate 4007, the liquid path formation member 4020 is connected to the ink delivery system also by the pressing plate 4007.

However, in this embodiment, the connective portion which is connected to the ink reception port 4009 of the recording element substrate 4001, the ink delivery path 4014, and the filtering apparatus 4016, are integrally formed within the main base board to which the driving element substrate 4001 is fixed. Therefore, the component count can be reduced relative to Embodiment 2, which it possible to reduce the number of the assembly steps, the recording head cost, and the recording head size.

Miscellaneous Embodiments

In each of the preceding embodiments, the present invention was described with reference to a heat generating element as the recording element which generates bubbles in ink as it receives a driving signal. However, the application of the present invention is not limited to these embodiments. For example, the recording element may be constituted of a piezo-electric element which mechanically displaces itself as it receives a driving signal.

Figure 15:
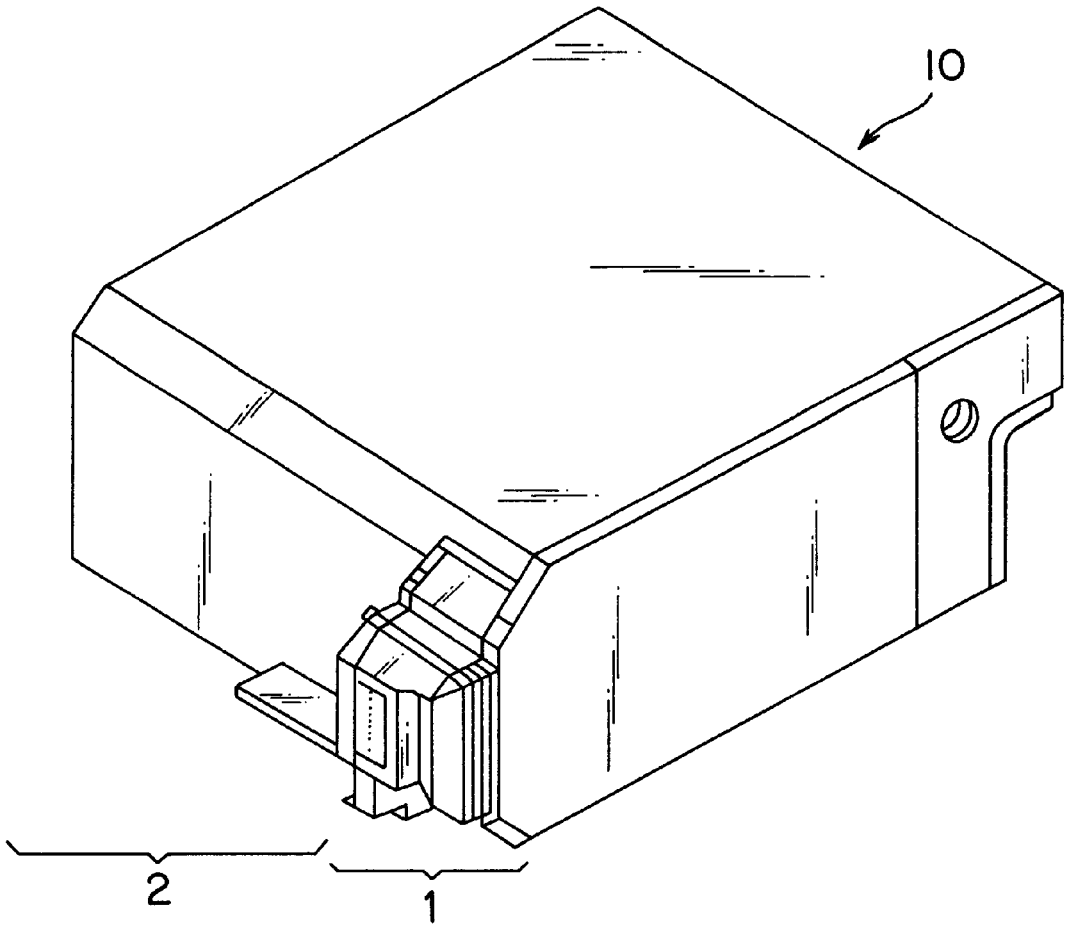
FIG. 15 is a schematic perspective view of an ink jet cartridge.

Also in each of the preceding embodiments, the present invention was described with reference to an ink jet recording head of a substantial length, but it is needless to say that the present invention is also applicable to a smaller head by reducing the size of each head component. A small recording head produced in the aforementioned manner can be used to realize a head cartridge illustrated in FIG. 15. In FIG. 15, a reference numeral 1 designates an ink jet recording head, and a reference numeral 2 designates an ink container which holds the ink to be delivered to the ink jet recording head.

Next, a full-line ink jet head in accordance with the present invention, and a desirable color ink jet apparatus comprising such an ink jet head, will be described.

Figure 16:
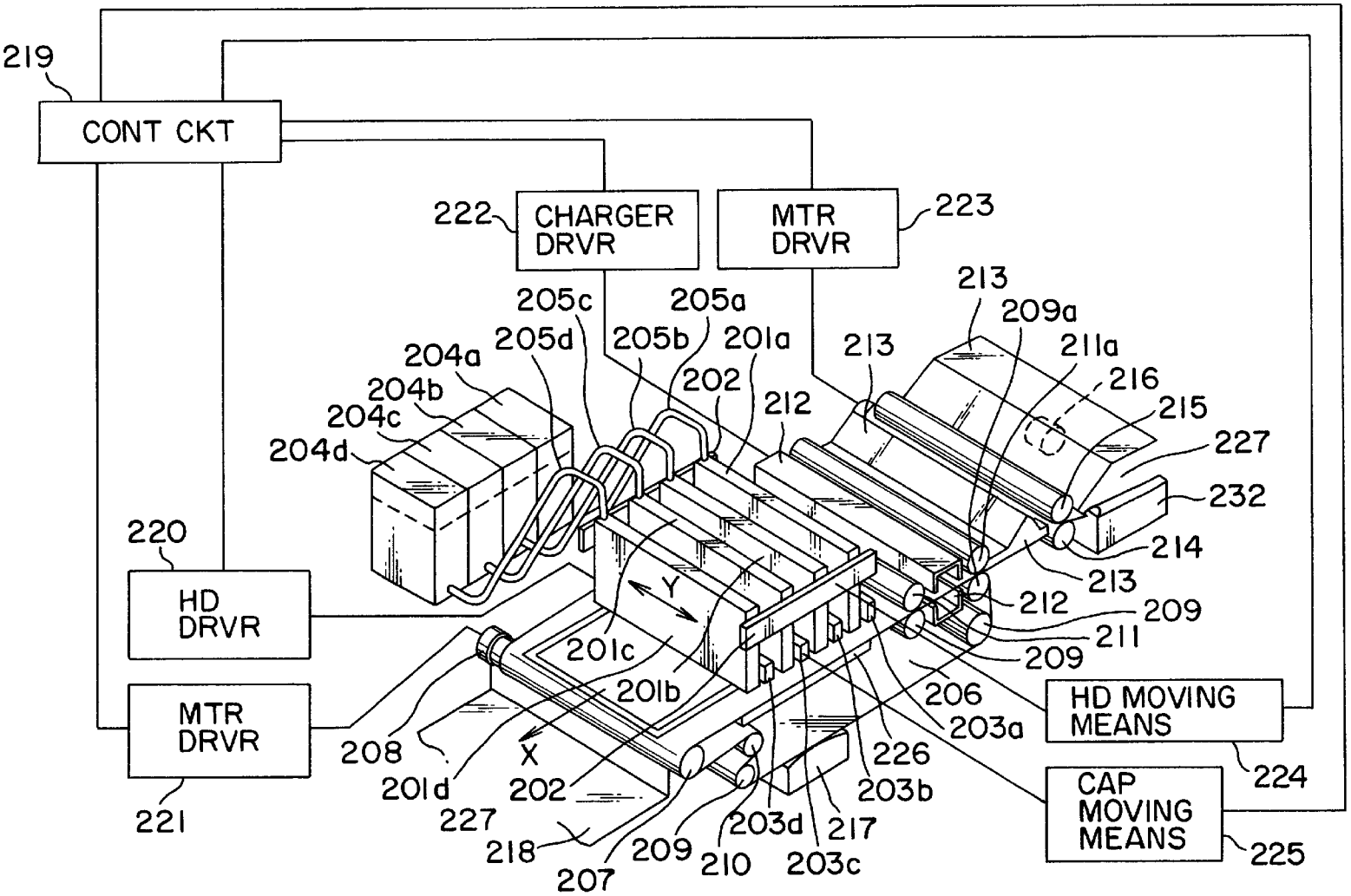
FIG. 16 is a schematic perspective view of an ink jet recording apparatus employing the head in accordance with the present invention.

FIG. 16 is a perspective view of an ink jet apparatus comprising an embodiment of an ink jet apparatus which most clearly manifests the characteristic of the present invention.

Referring to FIG. 16, the ink jet apparatus in this embodiment comprises full-line heads 201*a*–201*d* in which a plurality of ink ejection orifices are aligned to cover the recording width of the recording medium. These full-line heads are fixedly held in parallel to each other by a holder 202, with predetermined intervals, their longitudinal direction being perpendicular to the X direction in the drawing. On the downward facing surface of each head, 3,456 ejection orifices are aligned in the Y direction, at a density of 16 orifices per millimeter, which gives this ink jet apparatus a recording width of 218 mm.

As described in the preceding embodiments, each of these head comprises a plurality of element substrates, and employs a system which uses thermal energy to eject recording liquid. The recording liquid ejection from these heads is controlled by a head driver 220.

These heads inclusive of the holder 202 constitute the head unit of this embodiment, and this head unit is rendered vertically movable by a head moving mean 224.

At the bottom portion of each head, a head cap 203*a*, 203*b*, 203*c* or 203*d* is disposed adjacent to the head. Each cap contains an ink absorbent member formed of sponge or the like.

The cap is fixed by an unillustrated holder, and the cap and holder constitute a cap unit, which is movable in the X direction by a cap moving means 225.

Cyan color ink, magenta color ink, yellow color ink, and black ink, are delivered from ink containers 204*a*–204*d* to the corresponding color heads through the ink delivery tubes, making it possible to record in color.

Ink is delivered using capillarity in the ink ejection orifice, and therefore, the positional relationship between the ink container and the head is fixed in such a manner that the liquid surface level in the ink container remains below the ejection orifice by a predetermined distance.

Further, this apparatus comprises as a feeding means for feeding recording material a chargeable seamless belt 206 as a conveying means for conveying a recording paper or fabric 227, that is, the recording medium.

The belt 206 is routed through a predetermined path by various rollers, being fitted around a driving roller 207, and is drivable by a belt driving motor which is driven by a motor driver 221.

The belt 206 is driven in the X direction to pass directly below the ejection orifices of the head 201*a*, 201*b*, 201*c* or 201*d*, and when the belt 206 is in this region, a fixed supporting member 226 prevents the belt 206 from flapping downward.

The aforementioned, head driver 220, head moving means 224, cap moving means 225, motor driver 221, and motor driver 222, are all controlled by a controller circuit 219.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet recording head comprising:

a recording element substrate having a plurality of recording elements for generating energy for ejecting ink from ejection outlets;

an ink path formation member joined with said recording element substrate at a side thereof to form said ejection outlets, ink passages in fluid communication with said ejection outlets to supply ink to said ejection outlets, and a common ink chamber in fluid communication with said ink passages;

a driving element substrate having a driving element for selectively driving the recording elements to eject the ink from said ejection outlets;

urging means for urging and press-contacting together said recording element substrate and said driving element substrate so as to effect electrical connection therebetween, said urging means including an ink supply mechanism for fluid communication with said common ink chamber at a side of said ink path formation member opposite to the side joined with said recording element substrate.

2. An ink jet recording head according to claim 1, wherein said ink supply mechanism is in a form of an ink supply path formed in said urging means.

3. An ink jet recording head according to claim 1, wherein said recording elements are heat generating elements for creating bubbles by applying heat to the ink in the ink passages.

4. An ink jet recording head according to claim 1, wherein said recording elements are piezoelectric elements.

5. An ink jet recording head according to claim 1, wherein the ink supply mechanism comprises a filtering device that is integrally formed with the urging means.

6. An ink jet head cartridge, comprising:

an ink jet head including:

a recording element substrate having a plurality of recording elements for generating energy for ejecting ink from ejection outlets;

an ink path formation member joined with said recording element substrate at a side thereof to form said ejection outlets, ink passages in fluid communication with said ejection outlets to supply ink to said ejection outlets, and a common ink chamber in fluid communication with said ink passages;

a driving element substrate having a driving element for selectively driving the recording elements to eject the ink from said ejection outlets;

urging means for urging and press-contacting together said recording element substrate and said driving element substrate so as to effect electrical connection therebetween, said urging means including an ink supply mechanism for fluid communication with said common ink chamber at a side of said ink path formation member opposite to the side joined with said recording element substrate; and an ink container for containing the ink that is supplied to said ink chamber.

7. A cartridge according to claim 6, wherein said container contains the ink.

8. An ink jet recording head according to claim 6, wherein the ink supply mechanism comprises a filtering device that is integrally formed with the urging means.

9. An ink jet apparatus comprising:

an ink jet recording head including:

a recording element substrate having a plurality of recording elements for generating energy for ejecting ink from ejection outlets;

an ink path formation member joined with said recording element substrate at a side thereof to form said ejection outlets, ink passages in fluid communication with said ejection outlets to supply ink to said ejection outlets, and a common ink chamber in fluid communication with said ink passages;

a driving element substrate having a driving element for selectively driving the recording elements to eject the ink from said ejection outlets;

urging means for urging and press-contacting together said recording element substrate and said driving element substrate so as to effect electrical connection therebetween, said urging means including an ink supply mechanism for fluid communication with said common ink chamber at a side of said ink path formation member opposite to the side joined with said recording element substrate; and feeding means for feeding a recording material for receiving the ink.

10. An ink jet recording head according to claim 9, wherein the ink supply mechanism comprises a filtering device that is integrally formed with the urging means.

* * * * *

UNITED STATES PATENT AND TRADEMARK OFFICE

CERTIFICATE OF CORRECTION

PATENT NO. : 6,371,604 B1
DATED : April 16, 2002
INVENTOR(S) : Toru Yamane et al.

It is certified that error appears in the above-identified patent and that said Letters Patent is hereby corrected as shown below:

Title page,
Item [56], FOREIGN PATENT DOCUMENTS, “01302829” should read -- 01-302829 --.
Item [57], ABSTRACT,
Line 6, “driving element substrate” should be deleted;
Line 7, “urging member” should read -- urging means --;
Line 11, “urging member” should read -- urging means --.

Column 1,
Line 20, “medium” should read -- medium” --.

Column 2,
Line 48, “disclosed” should read -- disclosed in --;
Line 49, “FIG. 4,” should read -- FIGS. 4(a)-4(c), --.

Column 5,
Line 17, “and” should read -- an --.

Column 6,
Line 3, “system” (first occurrence) should read -- systems --.

Column 7,
Line 16, “apparatus 30016” should read -- apparatus 3016 --;
Line 50, “which” should read -- which makes --.

Column 8,
Line 25, “head” should read -- heads --.

UNITED STATES PATENT AND TRADEMARK OFFICE

CERTIFICATE OF CORRECTION

PATENT NO. : 6,371,604 B1
DATED : April 16, 2002
INVENTOR(S) : Toru Yamane et al.

It is certified that error appears in the above-identified patent and that said Letters Patent is hereby corrected as shown below:

Column 10,
Line 17, “recording head” should read -- head cartridge --;
Line 44, “recording head” should read -- apparatus --.

Signed and Sealed this

Third Day of September, 2002

*Attest:*

*Attesting Officer*

JAMES E. ROGAN
*Director of the United States Patent and Trademark Office*